US005154844A

United States Patent [19]

Perozzi

[11] Patent Number: 5,154,844

[45] Date of Patent: * Oct. 13, 1992

[54] LUBRICANT ADDITIVES AND THEIR PRODUCTION

[75] Inventor: Edmund F. Perozzi, Crestwood, Mo.

[73] Assignee: Ethyl Petroleum Additives, Inc., Richmond, Va.

[ * ] Notice: The portion of the term of this patent subsequent to Oct. 2, 2007 has been disclaimed.

[21] Appl. No.: 588,339

[22] Filed: Sep. 26, 1990

Related U.S. Application Data

[60] Continuation-in-part of Ser. No. 281,262, Dec. 7, 1988, Pat. No. 4,960,530, which is a continuation-in-part of Ser. No. 415,580, Oct. 2, 1989, Pat. No. 4,960,528, which is a division of Ser. No. 281,262, Dec. 7, 1989, which is a continuation-in-part of Ser. No. 494,656, Mar. 16, 1990, and Ser. No. 562,890, Aug. 30, 1990, said Ser. No. 281,262, is a continuation-in-part of Ser. No. 175,761, Mar. 31, 1988, abandoned, said Ser. No. 495,656, is a continuation-in-part of Ser. No. 304,772, Jan. 31, 1989, Pat. No. 5,028,345, which is a continuation-in-part of Ser. No. 281,262, Dec. 7, 1988, said Ser. No. 562,890, is a division of Ser. No. 281,262, Dec. 7, 1988.

[51] Int. Cl.[5] ..... C10M 135/02; C08H 3/00

[52] U.S. Cl. ..... 252/47.5; 252/48.6; 44/390; 44/400; 44/434; 44/435; 554/43; 554/85; 554/87

[58] Field of Search ..... 252/47.5; 260/399, 402.5

[56] References Cited

U.S. PATENT DOCUMENTS 4,960,528 10/1990 Everett et al. ..... 252/47
4,960,530 10/1990 Everett et al. ..... 252/48.6
5,028,345 7/1991 Everett et al. ..... 252/48.6

*Primary Examiner*—Ellen McAvoy
*Attorney, Agent, or Firm*—John F. Sieberth; Doris M. Thompson

[57] ABSTRACT

A product formed by heating (A) a mixture of a carboxylic acid ester and a fatty acid oxyalkylated amine derivative selected from fatty acid amides, fatty acid esters, fatty acid ester-amides of such oxyalkylated amine, and mixtures thereof with (B) sulfur or a sulfur source at an elevated temperature at which sulfurization occurs. Such products are effective as oil additives in inhibiting excessive wear and sludge formation. And they possess excellent compatibility with oils of lubricating viscosity, such as mineral oils used as crankcase lubricating oil base stocks.

31 Claims, No Drawings

LUBRICANT ADDITIVES AND THEIR PRODUCTION

RELATED APPLICATIONS

This application is a continuation-in-part of application Ser. No. 281,262 (now U.S. Pat. No. 4,960,320) filed Dec. 7, 1988, and of application Ser. No. 415,580 (now U.S. Pat. No. 4,960,528) filed on Oct. 2, 1989 as a division of said Ser. No. 281,262. This application is also a continuation-in-part of applications Ser. No. 494,656 (now allowed) filed on Mar. 16, 1990 and Ser. No. 562,890 filed on Aug. 30. 1990. Said application Ser. No. 281,262 is in turn a continuation-in-part of application Ser. No. 175,761 filed Mar. 31, 1988 and now abandoned. Said application Ser. No. 494,656 is a continuation-in-part of application Ser. No. 304,772 (now U.S. Pat. No. 4,028,345) filed Jan. 31, 1989, which in turn is a continuation-in-part of said Ser. No. 281,262 filed Dec. 7, 1988. Said application Ser. No. 562,890 filed Aug. 30, 1990 is a division of said application Ser. No. 281,262 filed Dec. 7, 1988.

TECHNICAL FIELD

This invention relates to cosulfurized additive blends having enhanced performance properties, and to processes for producing such compositions.

BACKGROUND

It has been common practice to include in lubricant formulation additives to provide improved antiwear and rust inhibition properties. In the past, sulfurized triglycerides, such as sulfurized lard oil, have been utilized, especially in association with lightly refined aromatic mineral oils which provided sufficient solubility for the sulfurized triglycerides.

With the increased concern for toxicity of aromatic compounds found in such mineral oils, lubricant formulations now comprise essentially non-aromatic oils. This change to substantially non-aromatic oils created a major problem, resulting from a significant decrease in solubility of the sulfurized triglycerides in the non-aromatic mineral oil, resulting in solidification and/or dropout of the sulfurized triglycerides.

While the solubility problem has been overcome, the modified lubricant products have been found to be either deficient in desirable lubricant properties or incapable of providing needed improvements in these properties.

In a typical approach to this problem, as reported in U.S. Pat. No. 3,455,896, sulfurized, low molecular weight polybutenes were reacted with liquid triglycerides, which were susceptible of sulfurization, to yield an additive. In U.S. Pat. No. 3,850,825, another additive was prepared by the sulfurization of a mixture of prime burning lard oil and alkyl oleate. In U.S. Pat. No. 3,740,333, $C_{10}$–$C_{16}$ alcohol esters of unsaturated fatty acids, having 18 to 22 carbon atoms, were blended with a triglyceride and either used "as is" or sulfurized. Modifications of such compositions have been reported in U.S. Pat. Nos. 4,149,982, 4,166,795, 4,166,796, 4,166,797 and 4,188,300. Esters of polymer acids have been employed as additives for metal-working aqueous dispersants and as fuel lubricant additives in, respectively, U.S. Pat. Nos. 4,067,817 and 4,167,486.

In U.S. Pat. No. 4,485,044 it is disclosed that the triglyceride compositions of the prior art, typically derived from plants and animals, have not provided maximum effectiveness as lubricant additives because of the chain length and/or the degree of unsaturation of the acid moiety. Thus, it is proposed to sulfurize esters of unsaturated dibasic carboxylic acids which may be sulfurized in the presence of transesterified triglycerides. It is further stated that modification of the acid moieties of the triglycerides, as by transesterification disclosed in U.S. Pat. Nos. 4,380,498 and 4,380,499, have produced novel triglycerides and have improved the properties of the resulting additive when said novel triglycerides were coupled, through sulfur bonds, with solubilizing components, such as esters and/or olefins.

More recently, U.S. Pat. No. 4,921,624 discloses that performance improvements are achieved by reacting a substantially saturated fatty acid triglyceride with a deficiency of dialkanol amine and combining such product with a sulfurized substantially unsaturated fatty acid triglyceride which may itself be a transesterified triglyceride for improved solubility.

This invention involves, inter alia, the discovery of new cosulfurized products which are even more effective in enhancing the performance of lubricant dispersants, especially polyisobutenyl succinimides of polyethylene polyamines such as tetraethylene pentamine, than products described in U.S. Pat. No. 4,921,624.

THE INVENTION

In accordance with this invention there is provided a cosulfurized blend of a carboxylic acid ester and a fatty acid oxyalkylated amine derivative selected from fatty acid amides, fatty acid esters, and fatty acid ester-amides of said oxyalkylated amine and mixtures thereof. Preferably, the carboxylic acid ester is a triglyceride such as, for example, tall oil, linseed oil, olive oil, castor oil, peanut oil, rapeseed oil, fish oil, sperm oil, coconut oil, lard oil, soybean oil, and mixtures of two or more thereof. Use of soybean oil as the carboxylic acid ester in the blend is particularly preferred. The preferred oxyalkylated amine derivatives are the fatty acid amides, fatty acid esters, and fatty acid ester-amides of an oxyalkylated amine having the formula

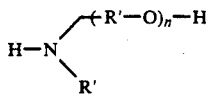

(I)

wherein R'' is a divalent aliphatic hydrocarbon radical containing 2–4 carbon atoms, n is an integer from 1 to 10 and R'' is selected from hydrogen and the group —R''—O)$_n$—H. Of these oxyalkylated amines, diethanol amine is particularly preferred. The fatty acid of the oxyalkylated amine derivatives is preferably derived from coconut oil. Accordingly, especially preferred oxyalkylated amine derivatives consist essentially of a coconut oil fatty acid amide of diethanol amine, a coconut oil fatty acid ester of diethanol amine, a coconut oil fatty acid ester-amide of diethanol amine, or a mixture of two or more thereof.

The sulfur content of the cosulfurized blends of this invention can be varied over a relatively wide range, depending of course upon the make-up of the blend being cosulfurized (e.g., the amount and character of the unsaturation therein), the proportions of the reactants employed, and the conditions under which they are reacted. In this connection, the term "cosulfurization" is used in its ordinary sense as denoting that the components of the blend—i.e., the carboxylic acid ester and the fatty acid oxyalkylated derivative—are both co-present during the sulfurization reaction. Preferred cosulfurized blends of this invention have sulfur contents in the range of about 2 to about 12 weight percent and preferably in the range of about 4 to about 8 weight percent. Most preferably, the sulfur content of the cosulfurized blend is about 6 weight percent.

The products of this invention are formed by heating (A) a mixture of a carboxylic acid ester and a fatty acid oxyalkylated amine derivative selected from fatty acid amides, fatty acid esters, fatty acid ester-amides of said oxyalkylated amine, and mixtures thereof with (B) sulfur or a sulfur source, at an elevated temperature at which sulfurization occurs.

Various types of materials can be used as a sulfur source for this reaction. Generally speaking, they are substances having more than 10 weight percent of sulfur, a substantial portion of which is highly active (e.g., highly corrosive to copper at elevated temperature, e.g., 160° C.). Such substances generally contain multiple sulfur atoms bonded together such as —S—S—S—S— or etc. Typical active sulfur-containing substances include sulfurized olefins such as sulfurized isobutylene, sulfurized fatty acids, sulfurized fats and oils, dihydrocarbyl polysulfides, especially polysulfides or mixtures of polysulfides which contain an average of more than three sulfur atoms per molecule, and similar substances.

Although various other procedures can be used, it is preferred to perform the cosulfurization with elemental sulfur at a cosulfurization temperature in the range of about 120° to about 180° C. Use of a catalyst, such as a mercapto-thiadiazole, notably 2,5-dimercapto-1,3,4-thiadiazole, in the cosulfurization reaction is advantageous and constitutes a preferred embodiment of this invention.

This invention thus includes the processes for producing the cosulfurized blends described above. These and other embodiments of this invention will be apparent from the ensuing description and appended claims.

As noted above, to produce the cosulfurized blends of this invention, three components are required: (i) a carboxylic acid ester or mixture thereof, (ii) a fatty acid oxyalkylated amine derivative selected from fatty acid amides, fatty acid esters, and fatty acid ester-amides of the oxyalkylated amine or any mixtures thereof, and (iii) sulfur or a suitable sulfur source.

Exemplary fatty acid esters for use as component (i) include lauryl tallate, methyl oleate, ethyl oleate, lauryl oleate, cetyl oleate, cetyl linoleate, lauryl ricinoleate, oleyl linoleate, oleyl stearate, and alkyl glycerides.

Preferred carboxylic acid esters for use as component (i) are the triglycerides derived from fats and oils such as tall oil, linseed oil, olive oil, castor oil, peanut oil, rapeseed oil, fish oil, sperm oil, coconut oil, lard oil, soybean oil, tallow, and the like, including mixtures of two or more such triglycerides. Materials of this type are available from various commercial sources, and methods for their preparation are well known and reported in the literature.

Typical compounds for use as component (ii) comprise fatty acid amides, fatty acid esters, and fatty acid ester-amides derived from an oxyalkylated amine having formula (I) set forth above. Such compounds can be made by reacting a fatty acid with an oxyalkylated amine such as ethanolamine, diethanolamine, isopropanolamine, diisopropanolamine, ethoxyethanolamine, di-(ethoxyethanol)amine, propanolamine, and the like. Reaction conditions as disclosed, for example, in U.S. Pat. No. 4,208,293 can be used in preparing such fatty acid oxyalkylated amine derivatives (component (ii) above). The disclosure of U.S. Pat. No. 4,208,293 is incorporated herein by reference. Preferred fatty acids used in making the amide, ester, ester-amide compounds which are employed as component (ii) above are those containing about 8–20 carbon atoms. Examples of these are hypogeic acid, oleic acid, linoleic acid, elaidic acid, abietic acid, dihydroabietic acid, dehydroabietic acid, tall oil fatty acids, erucic acid, brassidic acid, caprylic acid, pelargonic acid, capric acid, undecylic acid, lauric acid, tridecoic acid, myristic acid, palmitic acid, stearic acid, arachidic acid and mixtures thereof.

Most preferably, the fatty acid component is a mixture of acids derived from coconut oil.

It has been pointed out above that various active sulfur-containing substances can be used as a sulfur source (component (iii) above and typical substances of this type have been identified above. In general, such substances are sulfurized materials of the type used as antiwear and/or extreme pressure agents in gear oils and/or crankcase lubricants. Preferably, elemental sulfur is used as component (iii) in the cosulfurization. The most desirable and useful forms of elemental sulfur are flowers of sulfur and precipitated sulfur, both of which are readily available as articles of commerce.

It is desirable, though not essential, to employ a sulfurization catalyst in the cosulfurization procedure. Any of a wide variety of known sulfurization catalysts such as tertiary alkyl primary amines (e.g., Primene ®81R) may be used. Preferably, however, the catalyst is a thiadiazole sulfurization catalyst. Such materials may be represented by the formula

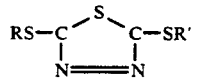

(II)

where each of R and R' is, independently a hydrogen atom or a hydrocarbyl group such as alkyl, alkenyl, cycloalkyl, cycloalkenyl, aryl, aralkyl, cycloalkylalkyl, etc., including substituted hydrocarbyl groups such as alkoxyalkyl, alkylthioalkyl, dialkylaminoalkyl, and the like. Usually the hydrocarbyl group will contain 50 carbon atoms or less, preferably 24 carbon atoms or less, and most preferably 16 carbon atoms or less. Examples of such compounds include butyldithiothiadiazole, diethyldithiothiadiazole, benzyldithiothiadiazole, diphenyldithiothiadiazole, oleyldithiothiadiazole, dicyclohexenyldithiothiadiazole, and the like. Dimercaptothiadiazole (R and R' in the above formula are hydrogen atoms) is a particularly preferred catalyst for use in the process. This compound is also known as 2,5-dimercapto-1,3,4-thiadiazole.

The process may be conducted in an inert liquid diluent (e.g., mineral oil, etc.) if desired, although in many cases this is not necessary as components (i) and (ii) above are often liquids especially at the reaction temperatures employed. In this connection, the reaction is usually performed at a temperature in the range of about 120° to about 180° C. and preferably in the range of about 155° to about 165° C. In some cases excessive heating or excessively prolonged heating may give side reactions with the formation of insoluble tarry coproduct(s). Thus the reaction should be conducted at a temperature within the foregoing ranges for a period of time such that sulfurization occurs without formation of insoluble tarry coproduct(s). In many cases, reaction times are less than one hour, although longer times may be used if the sulfurization temperatures are kept sufficiently low.

Water is evolved as a by-product of the reaction. Thus the reaction may be conducted in an open vessel or in any reactor equipped with means for removing water or water vapor from the system.

The proportions of the components, expressed in terms of moles, are generally as tabulated below:

| Component | General Range | Preferred Range | Most Preferred Range |
|---|---|---|---|
| (i) | 0.70–1.35 | 0.90–1.20 | 1.00–1.10 |
| (ii) | 1.00–3.10 | 1.70–2.30 | 1.90–2.20 |
| (iii) | 0.90–6.40 | 1.90–4.20 | 2.70–3.30 |

The amount of catalyst, when used, is generally up to about 15% and preferably in the range of 5 to 10% by weight of the sulfur (or sulfur source) employed.

It is desirable to mechanically agitate the reaction mixture to facilitate intimate contact among the reaction components. Any unreacted sulfur or other solids can be removed from the reaction product mixture by filtration, centrifugation or like techniques.

This invention is still further illustrated by the following examples in which all parts and percentages are by weight.

EXAMPLE 1

A mixture of 60 parts of coconut oil fatty acid diethanol amide (Schercomid SCO—extra), 90 parts of soybean oil, 9.57 parts of sulfur and 0.80 parts of 2,5-dimercapto-1,3,4-thiadiazole (DMTD) as catalyst are heated at about 160° C. for 30 minutes with stirring while allowing water vapor to escape and then cooled to avoid side reactions. The product contains 6 percent by weight sulfur.

EXAMPLE 2

The procedure of Example 1 is repeated substituting 90 parts of rapeseed oil for the soybean oil.

EXAMPLE 3

Example 1 is repeated except that 90 parts of tall oil is used in place of the soybean oil.

EXAMPLE 4

The procedure of Example 1 is repeated except that 90 parts of safflower seed oil is employed in lieu of the soybean oil.

EXAMPLE 5

Example 1 is repeated substituting 90 parts of linseed oil for the soybean oil.

EXAMPLE 6

The respective procedures of Examples 1–5 are repeated except that in each case 75 parts of oleic acid diethanol amide (formed as in Example 1 of U.S. Pat. No. 4,208,293) is used in place of the coconut oil fatty acid diethanol amide. In addition, the amount of the respective triglyceride oils used is increased to 113 parts, the amount of sulfur used is increased to 12 parts and the amount of DMTD catalyst used is increased to 1.0 parts.

EXAMPLE 7

The respective procedures of Examples 1–5 are repeated except that a combination of 30 parts of the coconut oil fatty acid diethanol amide and of Example 1 and 38 parts of oleic acid diethanol amide (formed as in Example 2 of U.S. Pat. No. 4,208,293) is used as the amide component in the respective reaction mixtures. Also, the amount of the respective triglyceride oils is increased to 102 parts, the amount of sulfur to 11 parts, and the amount of DMTD catalyst to 0.9 part.

The products of this invention are effective in reducing engine sludge formation and engine wear when used in natural and synthetic oils of lubricating viscosity. Amounts in the range of about 0.1 to 3% by weight in the oil are generally employed. Preferably, the concentration is in the range of about 0.2 to about 1% by weight in the oil.

The effectiveness of the cosulfurized products of this invention is illustrated by the results of several standard tests, namely the 4-Ball Wear test, a bench test simulating sludge formation in the Sequence V-E test, and a compatibility test conducted both at room temperature and at 70° C. The compositions tested and the results obtained are summarized in the following table in which the paranthetical amounts represent the weight percent of additive present in the oil.

| Additive | 4 Ball Wear (3-Comp)[2] | 4 Ball Wear (Full Pack)[3] | VE Sludge Bench Test[3,4] | Compatibility[5] RT | Compatibility[5] 70° C. |
|---|---|---|---|---|---|
| Cosulfurized coconut oil fatty acid diethanol-amide (Schercomid SCO-extra) and soybean oil[1] | 0.367 mm (.5%) | 0.342 (.5%) | 46.8 (.5%) | Trace Haze (28 days) | Clear (28 days) |
| Control | 0.544 mm (0%) | 0.413 (0%) | 77.6 (0%) | — | — |

[1]Prepared by heating a mixture of 60 grams cocodiethanolamide, 90 grams soybean oil, 9.57 grams sulfur and 0.80 grams of 2,5-dimercapto-1,3,4-thiadiazole (DMTD) to 160° C. with stirring for 30 minutes while allowing water vapor to escape and then cooling to avoid side reactions. The product contained 6% by weight sulfur.

[2]Composed of ZDDP antiwear agent, overbased calcium sulfonate and product formed as in Example 1.

[3]Fully formulated SAE 5W30 oil made by adding to base oil, succinimide dispersant, ZDDP antiwear, neutral and overbased calcium sulfonate detergents, antioxidants, antifoam agent, pour point depressant and VI improver.

[4]After 22–30 hours HOOT (Hot Oil Oxidation Test) the change in dielectric constant is determined. The oxidized oil is mixed with a known amount of standard oxidized oil (a laboratory preparation) and diluted with a hydrotreated basestock. Turbidity measurements are then taken. The dielectric constant measurement, HOOT time and turbidity data are combined into a single number for reporting and comparison purposes. A lower number indicates better anti-sludge properties.

[5]Compatibility of the listed additive with a conventional additive package used by oil blenders to prepare finished lubricating oils. The package used contains the same additives as the full pack of note 3 except that no VI improver or pour point depressant is present.

It is interesting to not that in the same VE Sludge Bench Test, the same fully formulated base oil containing 0.5% of SUL-PERM 60-93 (Keil Products Division of Ferro Corporation) gave a sludge rating of 51.7. Thus the cosulfurized product of Example 1 hereof was about 110% as effective as the commercially available product.

As can be seen from the data in the above table, the cosulfurized products of this invention can be used in combination with conventional lubricant additives, such as neutral and overbased alkali and/or alkaline earth metal sulfonates; zinc dihydrocarbyl dithiophosphates; ashless dispersants; viscosity index improvers; antioxidants; alkali and/or alkaline earth metal phenates, overbased phenates and/or sulfurized phenates; antiwear and/or extreme pressure agents; pour point depressants; friction reducing additives; anti-squawk agents; antifoam agents; rust inhibitors; and the like.

Overbased alkaline earth metal sulfonates are derived from sulfonic acids, particularly from petroleum sulfonic acids or alkylated benzene sulfonic acids. Useful sulfonic acids from which the overbased alkaline earth metal sulfonates are prepared have an average molecular weight of about 250–1500, more preferably about 400–1100, and most preferably about 440–600. Examples of specific sulfonic acids include mahogany sulfonic acids, petrolatum sulfonic acids, aliphatic sulfonic acids and cycloaliphatic sulfonic acids. In a highly preferred embodiment, the sulfonic acids are alkaryl sulfonic acids such as alkylbenzene or alkylnaphthalene sulfonic acids. Suitable alkyl groups contain from 10 to about 30 carbon atoms or more. Likewise, higher molecular weight alkyls derived from alkylation with polyolefin (e.g. polybutenes) having molecular weights up to about 2000 can be used to give hydrocarbyl sulfonic acids somewhat above the preferred range, but still useful.

Preferred sulfonic acids are the alkaryl sulfonic acids also referred to as alkylbenzene sulfonic acids.

Alkaryl sulfonic acids can be made by conventional methods such as by alkylating benzene, toluene or naphthalene or aromatic mixtures with olefins containing about 10–30 carbon atoms or more (e.g. with polyolefin). The most suitable olefins are cracked-wax olefins, propylene trimers and tetramers and olefin mixtures derived from aluminum alkyl chain growth. Alkylation is effected using a Friedel-Crafts (e.g. $AlCl_3$ or $BF_3$) catalyst. The alkylaromatic mixture contains predominantly mono- and di-alkyl products. These alkyl aromatics are then sulfonated by known methods such as by reaction with sulfuric acid, oleum, sulfur trioxide and the like.

Thus, preferred sulfonic acids include octadecylbenzene sulfonic acid, didodecylbenzene sulfonic acid, docosylbenzene sulfonic acid, triacontylbenzene sulfonic acid, dodecyloctadecylbenzene sulfonic acid, didecylbenzene sulfonic acid, dodecylnaphthalene sulfonic acid, hexadecylnaphthalene sulfonic acid, dinonylbenzene sulfonic acid and mixtures thereof and the like.

The hydrocarbyl sulfonic acids preferably have an average molecular weight of about 250–1500. More preferred are the alkylbenzene sulfonic acids having an average molecular weight of about 400–1100 and most preferably 440–600.

The overbased alkaline earth metal sulfonates are produced by neutralizing the sulfonic acid with an alkaline earth metal base to form an alkaline earth metal sulfonate salt and then overbasing the alkaline earth metal sulfonate with the corresponding alkaline earth metal carbonate. The process is conducted to give a total base number of at least 100, more preferably at least 300. There is no real maximum on total base number, but for practical purposes they seldom exceed about 550.

Overbased calcium petroleum sulfonates or alkaryl (e.g. alkylbenzene) sulfonates are especially preferred. These are prepared by neutralizing the corresponding petroleum sulfonic acid or alkylated benzene sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water.

Such additives are available commercially. For example, an overbased calcium sulfonate produced from a synthetic benzene sulfonic acid having a TBN of 310 can be obtained from Ethyl Petroleum Additives, Inc. under the designation HiTEC ®611 .

Zinc dihydrocarbyl dithiophosphates suitable for use include compounds in which the hydrocarbyl groups are alkyl, aryl, cycloalkyl or aralkyl groups, or mixtures of two or more such compounds.

Preferred zinc dihydrocarbyl dithiophosphates are represented by the formula:

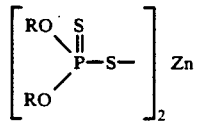

in which R is a hydrocarbyl radical having from 3 to 12 carbon atoms. The most preferred zinc dithiophosphates are those in which R represents an alkyl radical having from 3 to 8 carbon atoms such as isopropyl, isobutyl, isoamyl and 2-ethylhexyl. Examples of suitable compounds include zinc isobutyl 2-ethylhexyl dithiophosphate, zinc di(2-ethylhexyl)dithiophosphate, zinc isopropyl 2-ethylhexyl dithiophosphate, zinc isoamyl 2-ethylhexyl dithiophosphate and zinc dinonylphenyldithiophosphate.

Such additives are also available commercially. For example, a mixed 2-ethylhexyl, 2-methylpropyl, isopropyl ester of phosphorodithioic acid, zinc salt can be obtained from Ethyl Petroleum Additives, Inc. under the designation HiTEC ®685.

Ashless dispersants comprise various well known types of compounds such as the polyolefin-substituted succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. No. 3,172,892 and U.S. Pat. No. 3,219,666 incorporated herein by reference.

Another useful class of ashless dispersants are the polyolefin succinic esters of mono-and polyhydroxyl alcohols containing 1 to about 40 carbon atoms. Such dispersants are described in U.S. Pat. No. 3,381,022 and U.S. Pat. No. 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise, the succinic amide, imide and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. No. 3,368,972; U.S. Pat. No. 3,413.347; U.S. Pat. No. 3,442,808; U.S. Pat. No. 3,448,047; U.S. Pat. No. 3,539,633; U.S. Pat. No. 3,591,598; U.S. Pat. No. 3,600,372; U.S. Pat. No. 3,634,515; U.S. Pat. No. 3,697,574; U.S. Pat. No. 3,703,536; U.S. Pat. No. 3,704,308; U.S. Pat. No. 3,725,480; U.S. Pat. No. 3,726,882; U.S. Pat. No. 3,736,357; U.S. Pat. No. 3,751,365; U.S. Pat. No. 3,756,953; U.S. Pat. No. 3,793,202; U.S. Pat. No. 3,798,165; U.S. Pat. No. 3,798,247; and U.S. Pat. No. 3,803,039.

The above Mannich dispersants can be reacted with boric acid to form boronated dispersants having improved corrosion properties.

Other auxiliary additives that can be used such as viscosity index improvers and other types of additives referred to above are also well known to those skilled in the art and are extensively described and discussed in the patent literature. In addition, many such materials are readily available as articles of commerce. Hence further discussion concerning such substances would appear to be redundant.

The additives can be used in all types of natural and synthetic oils of lubricating viscosity. Natural oils include mineral oils and oleaginous materials derived from plants and animals. Mineral oils include those of suitable viscosity refined from crude oil from all sources including Gulfcoasts, midcontinent, Pennsylvania, California, Alaska, North Sea, Middle East, Mexico, Venezuela and the like. Various standard refinery operations can be used in processing the mineral oil.

Rapeseed oil, jojoba oil, tung oil, castor oil and the like typify oils of vegetable or plant origin.

Synthetic oil includes both hydrocarbon synthetic oil and synthetic esters. Useful synthetic hydrocarbon oils include polymers of alpha-olefins having the proper viscosity. Especially useful are the hydrogenated liquid oligomers of $C_{6-12}$ alphaolefins such as alpha-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylolpropane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are also useful. For example, blends of 5–25 wt.% hydrogenated alpha-decene trimer with 75–95 wt. % 150 SUS (100° F.) mineral oil. Likewise, blends of about 5–25 wt. % di-(2-ethylhexyl)adipate with mineral oil of proper viscosity results in a useful lubricating oil. Also, blends of synthetic hydrocarbon oil with synthetic esters can be used. Blends of mineral oil with synthetic oil are useful when preparing low viscosity oil (e.g. SAE 5W30) since they permit these low viscosities without contributing excessive volatility.

In many cases, a preferred way to add the present additives to lubricating oil is in the form of an additive package. These are concentrates dissolved in a diluent such as mineral oil, synthetic hydrocarbon oils and mixtures thereof which, when added to a base oil, will provide an effective concentration of the additives being used. The various additives are present in a proper ratio such that when a quantity of the concentrate is added to lubricating oil the various additives are all present in the proper concentration. Usually the concentrate will contain a minor proportion of a lubricating oil diluent and a major proportion of the additives employed in the particular formulation. However concentrates containing less than a major proportion of the additives are also entirely feasible and practicable. Thus the concentrate may contain as little as 5% by weight, or even less, of the additive package. The finished (i.e., fully compounded) oil will seldom contain more than about 20% by weight of the additive concentrate, although in special cases higher concentrations can be used, if desired.

The cosulfurized products of this invention can also be used as additives to motor fuels and burner fuels to control formation of sludge or deposits on engine or burner parts such as induction systems, intake valves and ports, nozzles, injectors, fuel lines, and the like. The fuels in which the cosulfurized products can be used include gasoline, diesel fuels, kerosenes, home heating oils, jet fuels, gas oils, cycle oils, bunker fuels, visbreaker oils, and the like. Amounts of up to about 5% by weight of the cosulfurized product are usually sufficient.

This invention is susceptible to considerable variation in its practice, all within the spirit and scope of the appended claims. Thus this invention is not intended to be limited to or by the specific exemplifications presented hereinabove.

I claim:

1. A product formed by heating (A) a mixture of a carboxylic acid ester and a fatty acid oxyalkylated amine derivative selected from fatty acid amides, fatty acid esters, fatty acid ester-amides of said oxyalkylated amine, and mixtures thereof with (B) sulfur or a sulfur source at an elevated temperature at which sulfurization occurs.

2. A product as claimed in claim 1 wherein said carboxylic acid ester is a triglyceride.

3. A product as claimed in claim 1 wherein said carboxylic acid ester is a triglyceride oil selected from tall oil, linseed oil, olive oil, castor oil, peanut oil, rapeseed oil, fish oil, sperm oil, coconut oil, lard oil, soybean oil, and mixtures of two or more thereof.

4. A product as claimed in claim 1 wherein said oxyalkylated amine of said derivative has the formula

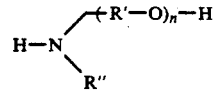

wherein R′ is a divalent aliphatic hydrocarbon radical containing 2–4 carbon atoms, n is an integer from 1 to 10 and R″ is selected from hydrogen and the group $-(-R'-O)_n-H$.

5. A product as claimed in claim 1 wherein said oxyalkylated amine of said derivative is diethanol amine.

6. A product as claimed in claim 1 wherein the fatty acid of said oxyalkylated amine derivative is derived from coconut oil.

7. A product as claimed in claim 1 wherein said derivative consists essentially of a coconut oil fatty acid amide of diethanol amine, a coconut oil fatty acid ester of diethanol amine, a coconut oil fatty acid ester-amide of diethanol amine, or a mixture of two or more thereof.

8. A product as claimed in claim 1 wherein the sulfur content of said product is in the range of about 2 to about 12 weight percent of said product.

9. A product as claimed in claim 1 wherein said carboxylic acid ester is a triglyceride oil selected from tall oil, linseed oil, olive oil, castor oil, peanut oil, rapeseed oil, fish oil, sperm oil, coconut oil, lard oil, soybean oil, and mixtures of two or more thereof, and wherein said derivative consists essentially of a coconut oil fatty acid amide of diethanol amine, a coconut oil fatty acid ester of diethanol amine, a coconut oil fatty acid ester-amide of diethanol amine, or a mixture of two or more thereof.

10. A product as claimed in claim 9 wherein the sulfur content of said product is in the range of about 4 to about 8 weight percent of said product.

11. A product as claimed in claim 9 wherein the sulfur content of said product is about 6 weight percent of said product.

12. A product as claimed in claim 1 wherein said carboxylic acid ester is soybean oil.

13. A product as claimed in claim 1 wherein said carboxylic acid ester is soybean oil, and wherein said derivative consists essentially of a coconut oil fatty acid amide of diethanol amine, a coconut oil fatty acid ester of diethanol amine, a coconut oil fatty acid ester-amide of diethanol amine, or a mixture of two or more thereof.

14. A product as claimed in claim 13 wherein the sulfur content of said product is in the range of about 4 to about 8 weight percent of said product.

15. A product as claimed in claim 9 wherein the sulfur content of said product is about 6 weight percent of said product.

16. A product as claimed in any of claims 1-15 wherein (B) is elemental sulfur, and wherein said temperature is in the range of about 120° to about 180° C.

17. A product as claimed in any of claims 1-15 wherein (B) is elemental sulfur, and wherein (A) and (B) are heated in the presence of at least one mercaptothiadiazole sulfurization catalyst.

18. A product as claimed in any of claims 1-15 wherein (B) is elemental sulfur, wherein said temperature is in the range of about 120° to about 180° C., and wherein (A) and (B) are heated in the presence of a sulfurization catalyst consisting essentially of 2,5-dimercapto-1,3,4-thiadiazole.

19. A process of cosulfurization which comprises heating (A) a mixture of a carboxylic acid ester and a fatty acid oxyalkylated amine derivative selected from fatty acid amides, fatty acid esters, fatty acid ester-amides of said oxyalkylated amine, and mixtures thereof with (B) sulfur or a sulfur source, at an elevated temperature at which sulfurization occurs.

20. A process as claimed in claim 19 wherein said carboxylic acid ester is a triglyceride.

21. A process as claimed in claim 19 wherein said carboxylic acid ester is a triglyceride oil selected from tall oil, linseed oil, olive oil, castor oil, peanut oil, rapeseed oil, fish oil, sperm oil, coconut oil, lard oil, soybean oil, and mixtures of two or more thereof.

22. A process as claimed in claim 19 wherein said oxyalkylated amine of said derivative has the formula

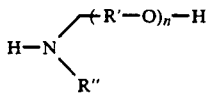

wherein R′ is a divalent aliphatic hydrocarbon radical containing 2–4 carbon atoms, n is an integer from 1 to 10 and R″ is selected from hydrogen and the group $(R'—O)_n—H$.

23. A process as claimed in claim 19 wherein said oxyalkylated amine of said derivative is diethanolamine.

24. A process as claimed in claim 19 wherein the fatty acid of said oxyalkylated amine derivative is derived from coconut oil.

25. A process as claimed in claim 19 wherein said derivative consists essentially of a coconut oil fatty acid amide of diethanol amine, a coconut oil fatty acid ester of diethanol amine, a coconut oil fatty acid ester-amide of diethanol amine, or a mixture of two or more thereof.

26. A process of claim 19 wherein carboxylic acid ester is a triglyceride oil selected from tall oil, linseed oil, olive oil, castor oil, peanut oil, rapeseed oil, fish oil, sperm oil, coconut oil, lard oil, soybean oil, and mixtures of two or more thereof, and wherein said derivative consists essentially of a coconut oil fatty acid amide of diethanol amine, a coconut oil fatty acid ester of diethanol amine, a coconut oil fatty acid ester-amide of diethanol amine, or a mixture of two or more thereof.

27. A process as claimed in claim 19 wherein said carboxylic acid ester is soybean oil.

28. A process as claimed in claim 19 wherein said carboxylic acid ester is soybean oil, and wherein said derivative consists essentially of a coconut oil fatty acid amide of diethanol amine, a coconut oil fatty acid ester of diethanol amine, a coconut oil fatty acid ester-amide of diethanol amine, or a mixture of two or more thereof.

29. A process as claimed in any of claims 19-28 wherein the cosulfurization is performed with elemental sulfur at a cosulfurization temperature in the range of about 120° to about 180° C.

30. A process as claimed in any of claims 19-28 wherein the cosulfurization is performed with elemental sulfur at a cosulfurization temperature in the range of about 120° to about 180° C., and wherein the cosulfurization is conducted in the presence of a mercaptothiadiazole catalyst.

31. A cosulfurized blend of a carboxylic acid ester and a fatty acid oxyalkylated amine derivative selected from fatty acid amides, fatty acid esters, fatty acid ester-amides of said oxyalkylated amine, and mixtures thereof.

* * * * *

UNITED STATES PATENT AND TRADEMARK OFFICE

CERTIFICATE OF CORRECTION

PATENT NO. : 5,154,844

DATED : OCTOBER 13, 1992

INVENTOR(S) : EDMUND F. PEROZZI

It is certified that error appears in the above-identified patent and that said Letters Patent is hereby corrected as shown below:

Title page:

Item (60): (Related Applications), Line 7 , reads "U. S. Pat. No. 4,960,320)" and should read -- U. S. Pat. No. 4,960,530 --.

Column 1(Related Applications), Line 18, reads "U. S. Pat. No. 4,028,345", and should read -- U. S. Pat. No. 5,028,345 --.

Column 2, Line 49, reads "...wherein R"..." and should read -- wherein R'--.

Signed and Sealed this

First Day of February, 1994

Bruce Lehman

*Attest:*

BRUCE LEHMAN

*Attesting Officer*

*Commissioner of Patents and Trademarks*